US010168029B1

(12) United States Patent
Hsu

(10) Patent No.: US 10,168,029 B1
(45) Date of Patent: Jan. 1, 2019

(54) REPLACEABLE CEILING FITTING MOUNTED QUICKLY

(71) Applicant: Dong Guan Bright Yinhuey Lighting Co., Ltd. China, Guang Dong (CN)

(72) Inventor: Kevin Hsu, Taichung (TW)

(73) Assignee: Dong Guan Bright Yinhuey Lighting Co., Ltd. China, Guang Dong (CN)

( * ) Notice: Subject to any disclaimer, the term of this patent is extended or adjusted under 35 U.S.C. 154(b) by 0 days.

(21) Appl. No.: 15/706,848

(22) Filed: Sep. 18, 2017

(51) Int. Cl.
*F21V 21/108* (2006.01)
*F21V 17/18* (2006.01)
*F21V 21/03* (2006.01)
*F21S 8/04* (2006.01)

(52) U.S. Cl.
CPC ..... *F21V 17/18* (2013.01); *F21S 8/043* (2013.01); *F21V 21/03* (2013.01)

(58) Field of Classification Search
CPC ..... F21V 17/18; F21V 21/03; F21S 8/043
USPC ..... 362/404, 370
See application file for complete search history.

(56) References Cited

U.S. PATENT DOCUMENTS 4,887,073 A * 12/1989 Nakao ..... G08B 17/00 340/628
6,457,848 B1 * 10/2002 Wolf ..... F21S 8/02 248/343
9,890,941 B2 * 2/2018 Boomgaarden ..... F21V 29/71
2012/0026744 A1 * 2/2012 Peter ..... F21V 21/02 362/370

* cited by examiner

*Primary Examiner* — Karl D Frech
(74) *Attorney, Agent, or Firm* — Alan D. Kamrath; Kamrath IP Lawfirm, P.A.

(57) ABSTRACT

A ceiling fitting includes a base, a mounting bracket mounted on the base, a lampshade mounted on the base, a lighting assembly located between the base and the lampshade, and two fasteners locked onto the base and the mounting bracket. The lampshade has an inner wall provided with two locking members. The two fasteners are locked onto the two locking members. Thus, the two fasteners lock the mounting bracket on the base, and removably mount the lampshade on the base, thereby facilitating the user assembling and disassembling the ceiling fitting.

11 Claims, 4 Drawing Sheets

REPLACEABLE CEILING FITTING MOUNTED QUICKLY

BACKGROUND OF THE INVENTION

1. Field of the Invention

The present invention relates to an illuminating device and, more particularly, to a ceiling fitting.

2. Description of the Related Art

A ceiling fitting is mounted on a ceiling or wall to provide a lighting function. A conventional ceiling fitting comprises a bottom shell, a light source and a lampshade. In assembly, the light source and the lampshade are removed from the bottom shell. Then, the bottom shell is affixed to the ceiling or wall. Then, the light source and the lampshade are mounted on the bottom shell by fasteners. However, the conventional ceiling fitting is not assembled or disassembled easily and conveniently, thereby causing inconvenience to the user, and thereby wasting the working time and energy.

BRIEF SUMMARY OF THE INVENTION

The primary objective of the present invention is to provide a replaceable ceiling fitting that is mounted quickly.

In accordance with the present invention, there is provided a ceiling fitting comprising a base, a mounting bracket mounted on the base, a lampshade mounted on the base, a lighting assembly located between the base and the lampshade, and two fasteners locked onto the base and the mounting bracket. The base has a peripheral wall provided with two fixing holes. The mounting bracket is provided with two mounting holes formed on two opposite ends thereof. The lampshade has an inner wall provided with two locking members. Each of the two locking members is provided with a mounting slot which has a first end provided with a guiding portion and a second end provided with a restriction portion which has a locking groove. Each of the two fasteners includes a threaded rod and a nut. The threaded rod of each of the two fasteners is screwed into one of the two mounting holes of the mounting bracket and one of the two fixing holes of the base to affix the mounting bracket to the base. The nut of each of the two fasteners protrudes outward from the peripheral wall of the base. When the lampshade is mounted on the base, the nut of each of the two fasteners aligns with the mounting slot of one of the two locking members. When the lampshade is rotated relative to the base, the nut of each of the two fasteners is introduced into the mounting slot of one of the two locking members. The nut of each of the two fasteners is inserted through the guiding portion into the restriction portion of one of the two locking members and is locked in the locking groove of the restriction portion.

According to the primary advantage of the present invention, the lampshade is mounted on and detached from the base easily and conveniently by cooperation of the two fasteners and the two locking members, thereby facilitating the user replacing or repairing the ceiling fitting.

According to another advantage of the present invention, the two fasteners lock the mounting bracket on the base, and removably mount the lampshade on the base, thereby simplifying the construction of the ceiling fitting, and thereby facilitating the user assembling and disassembling the ceiling fitting.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
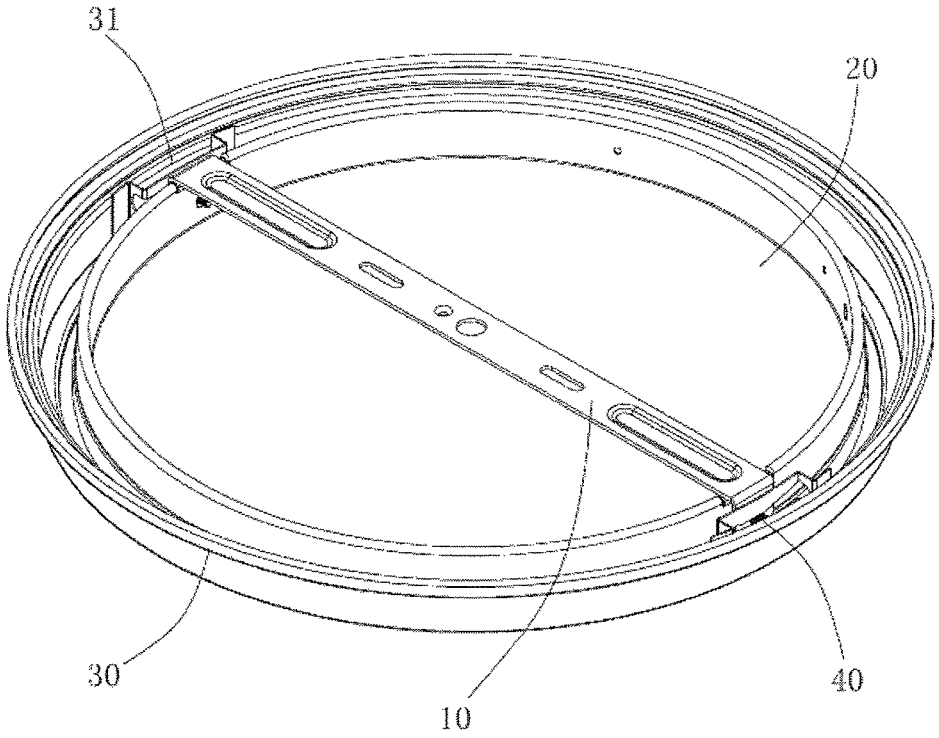
FIG. 1 is a perspective view of a ceiling fitting in accordance with the preferred embodiment of the present invention.

Referring to FIGS. 1-4, a ceiling fitting in accordance with the preferred embodiment of the present invention comprises a base 20, a mounting bracket 10 mounted on the base 20, a lampshade 30 mounted on the base 20, a lighting assembly located between the base 20 and the lampshade 30, and two fasteners 40 locked onto the base 20 and the mounting bracket 10.

The base 20 has a peripheral wall 21 provided with two fixing holes 22. The mounting bracket 10 is provided with two mounting holes 12 formed on two opposite ends 11 thereof. The two opposite ends 11 of the mounting bracket 10 are bent and mounted on the base 20 by the two fasteners 40.

The lampshade 30 has an inner wall provided with two locking members 31. Each of the two locking members 31 is provided with a mounting slot 311 which has a first end provided with a guiding portion 315 and a second end provided with a restriction portion 316 which has a locking groove 317. The mounting slot 311 of each of the two locking members 31 extends transversely.

Each of the two fasteners 40 includes a threaded rod 41 and a nut 42. The threaded rod 41 of each of the two fasteners 40 is screwed into one of the two mounting holes 12 of the mounting bracket 10 and one of the two fixing holes 22 of the base 20 to affix the mounting bracket 10 to the base 20. The nut 42 of each of the two fasteners 40 protrudes outward from the peripheral wall 21 of the base 20.

In assembly, when the lampshade 30 is mounted on the base 20, the nut 42 of each of the two fasteners 40 aligns with the mounting slot 311 of one of the two locking members 31. When the lampshade 30 is rotated relative to the base 20, the nut 42 of each of the two fasteners 40 is introduced into the mounting slot 311 of one of the two locking members 31. Thus, the nut 42 of each of the two fasteners 40 is inserted through the guiding portion 315 into the restriction portion 316 of one of the two locking members 31 and is locked in the locking groove 317 of the restriction portion 316.

In the preferred embodiment of the present invention, the restriction portion 316 of each of the two locking members 31 is located between the guiding portion 315 and the locking groove 317, and the locking groove 317 of each of the two locking members 31 is formed on a top wall of the restriction portion 316.

In the preferred embodiment of the present invention, the guiding portion 315 of each of the two locking members 31 is inclined downward to connect the restriction portion 316 and has a width reduced gradually toward the restriction portion 316.

In the preferred embodiment of the present invention, the restriction portion 316 of each of the two locking members 31 extends horizontally and has a width smaller than that of the guiding portion 315. The nut 42 of each of the two fasteners 40 has a dimension that is smaller than the width of the guiding portion 315 of each of the two locking members 31 and fits the width of the restriction portion 316 of each of the two locking members 31. Thus, the nut 42 of each of the two fasteners 40 is introduced into the mounting slot 311 of one of the two locking members 31 easily and conveniently.

In the preferred embodiment of the present invention, the lampshade 30 is provided with a limit portion 32 located under the two locking members 31. Preferably, the limit portion 32 has an annular shape. The base 20 has a lower face resting on the limit portion 32 of the lampshade 30.

In the preferred embodiment of the present invention, each of the two locking members 31 has a hollow interior provided with a through hole 312 which extends through each of the two locking members 31 from top to bottom. Thus, the through hole 312 reduces the material of each of the two locking members 31 and saves the cost of fabrication.

In the preferred embodiment of the present invention, the mounting bracket 10 is provided with a plurality of positioning holes, and a plurality of fastening members extend through the positioning holes of the mounting bracket 10 to secure the mounting bracket 10 to a ceiling or a wall.

In the preferred embodiment of the present invention, each of the two locking members 31 includes a resting face 313 resting on the peripheral wall 21 of the base 20 and two connecting faces 314 located at two opposite ends of the resting face 313, and the mounting slot 311 is formed in the resting face 313. The resting face 313 of each of the two locking members 31 extends transversely and has a shape matching that of the peripheral wall 21 of the base 20.

Figure 2:
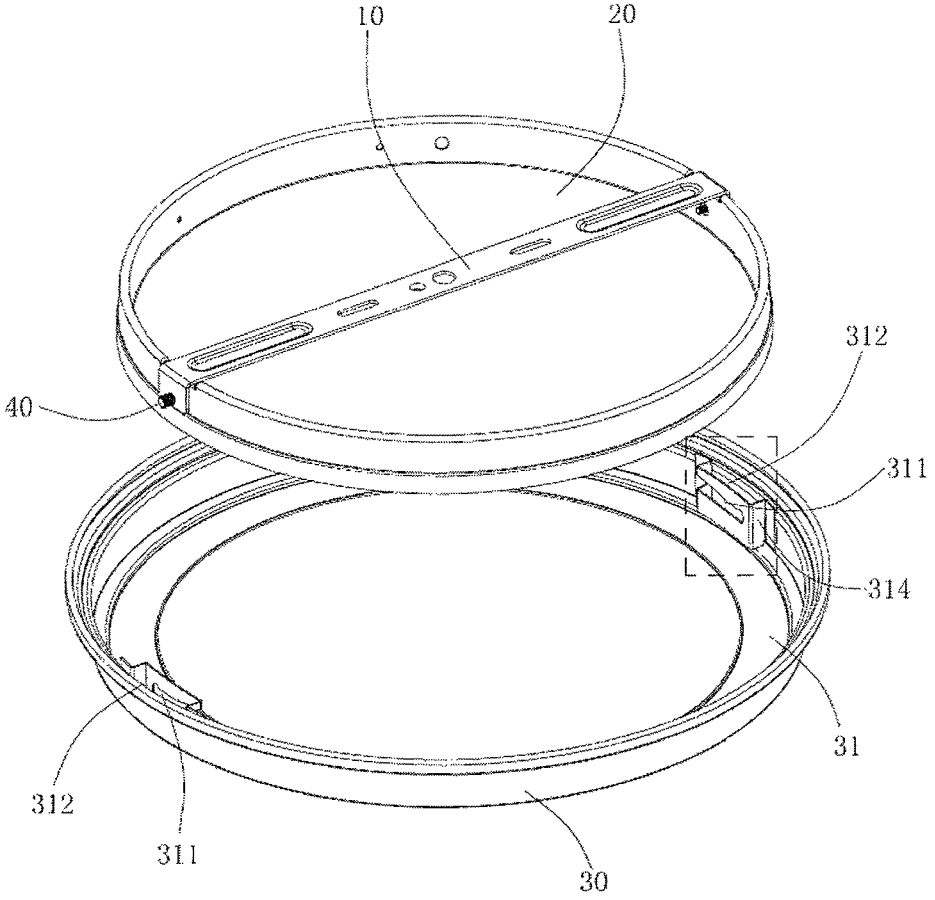
FIG. 2 is a partially exploded perspective view of the ceiling fitting in accordance with the preferred embodiment of the present invention.
Figure 3:
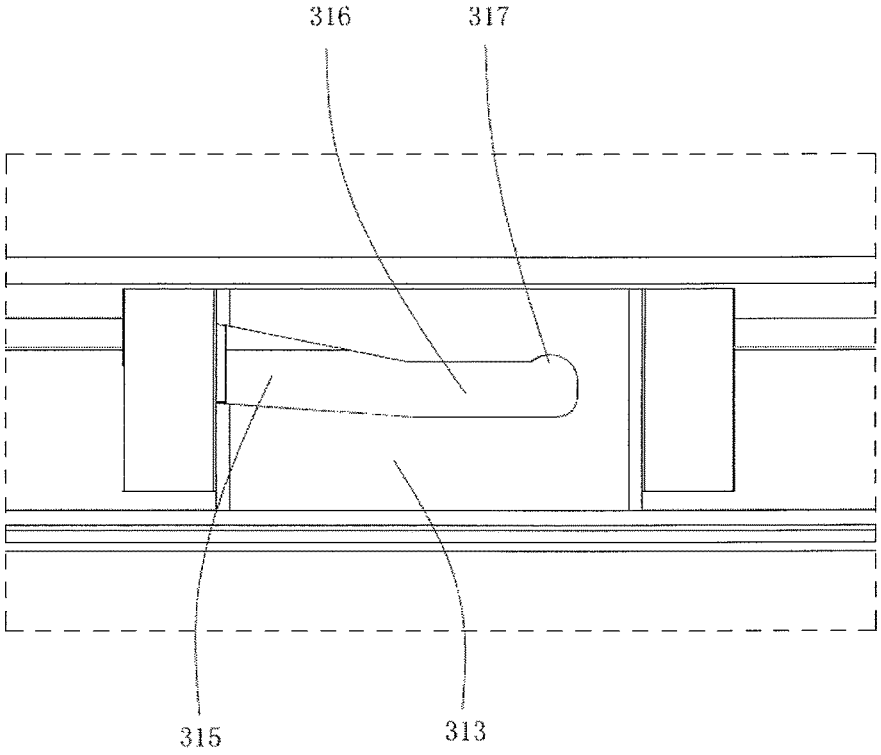
FIG. 3 is a front planar view of a locking member of the ceiling fitting in accordance with the preferred embodiment of the present invention.
Figure 4:
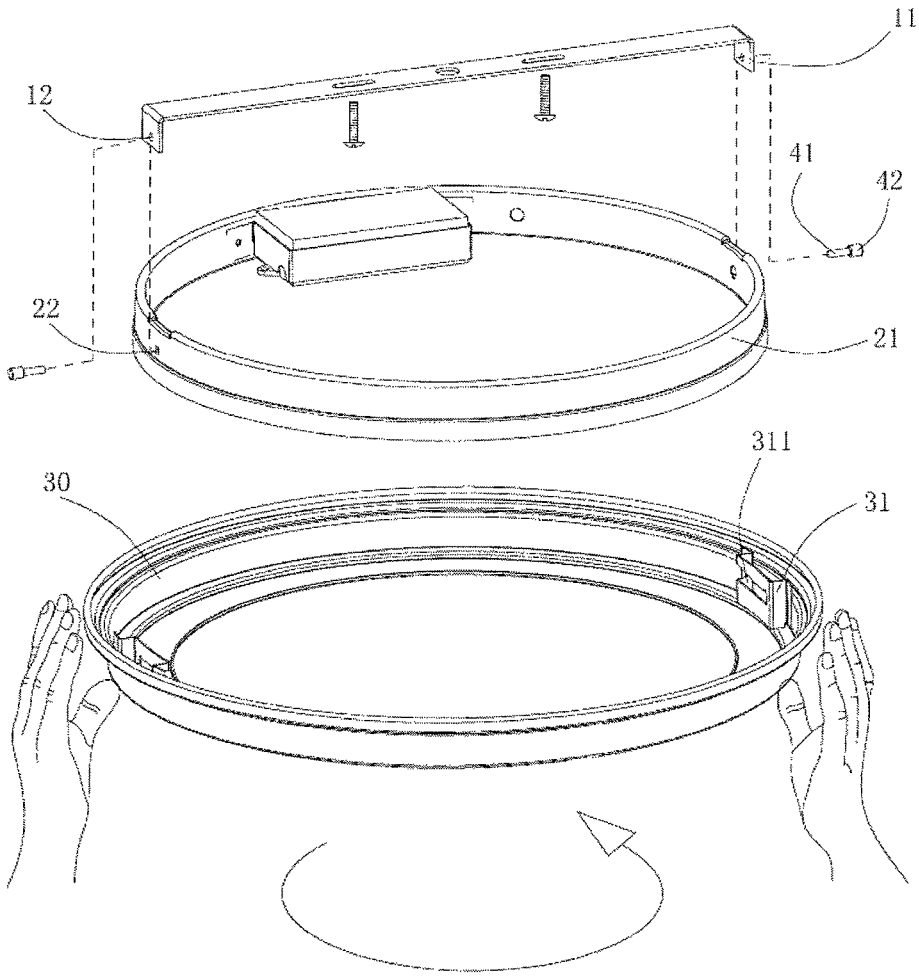
FIG. 4 is an exploded perspective view showing assembly of the ceiling fitting in accordance with the preferred embodiment of the present invention.

In mounting of the ceiling fitting, referring to FIG. 4 with reference to FIGS. 1-3, when the mounting bracket 10 is mounted on the base 20, the threaded rod 41 of each of the two fasteners 40 is screwed into one of the two mounting holes 12 of the mounting bracket 10 and one of the two fixing holes 22 of the base 20 to affix the mounting bracket 10 to the base 20. At this time, the nut 42 of each of the two fasteners 40 protrudes outward from the peripheral wall 21 of the base 20. Then, the lampshade 30 is mounted on the base 20, with the nut 42 of each of the two fasteners 40 aligning with the mounting slot 311 of one of the two locking members 31. When the lampshade 30 is rotated relative to the base 20, the nut 42 of each of the two fasteners 40 is introduced into the mounting slot 311 of one of the two locking members 31. Thus, the nut 42 of each of the two fasteners 40 is inserted through the guiding portion 315 into the restriction portion 316 of one of the two locking members 31. At this time, the locking groove 317 of each of the two locking members 31 is located at the top of the restriction portion 316, so that the lampshade 30 is moved downward relative to the base 20 by action of the gravity, so that the nut 42 of each of the two fasteners 40 is inserted into and locked in the locking groove 317 of the restriction portion 316. Thus, the nut 42 of each of the two fasteners 40 is locked by each of the two locking members 31, so that the lampshade 30 is mounted on the base 20 solidly and steadily.

Accordingly, the lampshade 30 is mounted on and detached from the base 20 easily and conveniently by cooperation of the two fasteners 40 and the two locking members 31, thereby facilitating the user replacing or repairing the ceiling fitting. In addition, the two fasteners 40 lock the mounting bracket 10 on the base 20, and removably mount the lampshade 30 on the base 20, thereby simplifying the construction of the ceiling fitting, and thereby facilitating the user assembling and disassembling the ceiling fitting.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A ceiling fitting comprising:

a base;

a mounting bracket mounted on the base;

a lampshade mounted on the base;

a lighting assembly located between the base and the lampshade; and two fasteners locked onto the base and the mounting bracket and detachably locked onto the lampshade;

wherein:

the base has a peripheral wall provided with two fixing holes;

the mounting bracket is provided with two mounting holes formed on two opposite ends thereof;

the lampshade has an inner wall provided with two locking members;

each of the two locking members is provided with a mounting slot which has a first end provided with a guiding portion and a second end provided with a restriction portion which has a locking groove;

each of the two fasteners includes a threaded rod and a nut;

the threaded rod of each of the two fasteners is screwed into one of the two mounting holes of the mounting bracket and one of the two fixing holes of the base to affix the mounting bracket to the base;

the nut of each of the two fasteners protrudes outward from the peripheral wall of the base;

when the lampshade is mounted on the base, the nut of each of the two fasteners aligns with the mounting slot of one of the two locking members;

the nut of each of the two fasteners is slidable in the guiding portion and the restriction portion of the mounting slot of one of the two locking members;

when the lampshade is rotated relative to the base, the nut of each of the two fasteners is introduced into the mounting slot of one of the two locking members; and the nut of each of the two fasteners is inserted through the guiding portion into the restriction portion of one of the two locking members and is locked in the locking groove of the restriction portion.

2. The ceiling fitting of claim 1, wherein:

the mounting slot of each of the two locking members extends transversely and allows sliding of the nut of each of the two fasteners;

the restriction portion of each of the two locking members is located between the guiding portion and the locking groove; and the locking groove of each of the two locking members is formed on a top wall of the restriction portion.

3. The ceiling fitting of claim 1, wherein the guiding portion of each of the two locking members is inclined downward with a lower portion connecting the restriction portion and has a width reduced gradually toward the restriction portion.

4. The ceiling fitting of claim 1, wherein the restriction portion of each of the two locking members extends horizontally and is located at a position lower than that of the guiding portion.

5. The ceiling fitting of claim 1, wherein the lampshade is provided with an annular limit portion located under and spaced from the two locking members, and the base has a lower face resting on the limit portion of the lampshade.

6. The ceiling fitting of claim 1, wherein each of the two locking members has a hollow interior provided with a through hole which extends through each of the two locking members from top to bottom and is connected to the mounting slot.

7. The ceiling fitting of claim 1, wherein the mounting bracket is provided with a plurality of positioning holes, and a plurality of fastening members extend through the positioning holes of the mounting bracket to secure the mounting bracket to a ceiling or a wall.

8. The ceiling fitting of claim 1, wherein the two opposite ends of the mounting bracket are located outside of the base and rest on the peripheral wall of the base.

9. The ceiling fitting of claim 1, wherein the nut of each of the two fasteners protrudes outward from each of the two opposite ends of the mounting bracket.

10. The ceiling fitting of claim 1, wherein the base is received in the lampshade.

11. The ceiling fitting of claim 1, wherein the two locking members are located in the lampshade.

* * * * *